United States Patent [19]

Bartlett

[11] Patent Number: 4,632,300

[45] Date of Patent: Dec. 30, 1986

[54] CONTAINER PARTITION

[75] Inventor: John R. Bartlett, Columbus, Ohio

[73] Assignee: Owens-Illinois, Inc., Toledo, Ohio

[21] Appl. No.: 762,476

[22] Filed: Aug. 5, 1985

[51] Int. Cl.[4] ..... B65D 5/48

[52] U.S. Cl. ..... 229/15; 229/28 R

[58] Field of Search ..... 229/15, 27, 28 R, 29 D, 229/42

[56] References Cited

U.S. PATENT DOCUMENTS

| | | | |
|---|---|---|---|
| 2,527,702 | 10/1950 | Buttery | 229/15 |
| 2,587,706 | 3/1952 | DeLine | 229/15 |
| 3,031,813 | 5/1962 | Ganz | 229/15 |
| 3,187,981 | 6/1965 | Farquhar et al. | 229/42 |
| 3,285,493 | 11/1966 | Coe et al. | 229/15 |
| 3,300,076 | 1/1967 | Wohl | 229/15 |
| 3,352,473 | 11/1967 | Graser | 229/15 |
| 3,498,450 | 3/1970 | Stevens | 229/42 |
| 3,868,055 | 2/1975 | Langen et al. | 229/15 |
| 4,330,078 | 5/1982 | Graser | 229/15 |

*Primary Examiner*—William Price
*Assistant Examiner*—Gary E. Elkins
*Attorney, Agent, or Firm*—John R. Nelson

[57] ABSTRACT

A machine erectable compartmented multi-cell one-piece container partition formed from a unitary blank of foldable paperboard to separate articles in a box. A rectangular, planar, horizontally-disposed blank of foldable sheet material is cut and folded to provide vertically disposed flaps or segments of single thickness forming separator walls defining a plurality of separator cells (preferably twelve) to separate segregated articles at their contact points, with the blank having a length and width not exceeding inside box dimensions. Each of the vertically disposed segments is folded from the blank along a hinge line disposed intermediate the top and bottom ends of each segment, whereby the segments extend above and below the plane of the blank to form walls of the separator cells.

16 Claims, 4 Drawing Figures

CONTAINER PARTITION

BACKGROUND OF THE INVENTION

The invention relates to container partitions formed from foldable material, such as cardboard, for the accommodation of segregated articles such as, for example, bottles, and the like, the articles being separated from one another at their contact points by longitudinal and transverse flaps or segments.

Many items, such as empty bottles, jars and foodstuffs in glass containers are sold as multiple units in shipping containers. However, depending upon the fragility of the items packaged, a serious problem of breakage can occur by the time the products reach the hands of the consumer. In order to prevent such breakage, it is desirable to provide a cellular structure to prevent contact between the items during shipment and storage.

In one prior art type, rectangular containers are divided into cells by means of intersecting partition units. For example, in a container designed to contain twelve bottles, the partition units are usually formed by two parallel longitudinally extending divider elements which are intersected by three partition forming members. The partition forming members are usually slotted in such a manner as to fit together and to provide walls separating the bottles one from another. While such devices have been used for a great number of years, it is necessary to interconnect the various partition members in order to produce the cell structure—and this type construction requires a great deal of waste material when packaging cylindrical objects, etc.

In another prior art construction, the partitions are formed of single blank folded cardboard for the accommodation of bottles or jars, have segments or flaps arranged between adjacent bottles or jars and are available in a wide variety of designs.

However, prior partitions have many shortcomings rendering them expensive and unsuitable for machine erection and placement in a box. It is imperative that the partition be simple in construction so that it may be rapidly produced from a single blank. It must have simple folds with segments of single thickness such that it may be machine erected and placed in a box.

Therefore, it is an object of the invention to provide an economical container partition rapidly produced from a single blank and which may be machine erected and placed in a box and which requires a minimum of paperboard for its construction.

A further object of the invention is to produce a container partition of the above type wherein separating flaps or segments are of single thickness and are secured or hinged to the blank at a point intermediate their ends.

A further object of the invention is to provide a container partition of the above type that is simple in construction, inexpensive to manufacture, and highly effective in operation.

BRIEF DESCRIPTION OF THE INVENTION

Briefly, the foregoing objects are accomplished by the provision of a machine erectable compartmented multi-cell one-piece container partition formed from a unitary blank of foldable paperboard to prevent contact between segregated articles in a box. A rectangular planar horizontally-disposed blank of foldable sheet material is cut and folded to provide (preferably seventeen) vertically disposed flaps or segments of a single thickness forming separator walls defining a plurality of separator cells (preferably twelve) to separate the segregated articles at their contact points, with the flat as well as erected blank having a length and width not to exceed inside box dimensions. Each of the vertically disposed segments is formed of a single thickness of the blank and is folded from the blank along a hinge line disposed intermediate the top and bottom ends of each segment, whereby the segments extend above and below the plane of the blank to form the walls of the separator cells. The segments or separators may extend below the plane of the blank an equal distance, and/or above the plane of the blank an equal distance. The easily erected partition does not have to touch the top or bottom of the container as long as the jars are separated from each other at their contact points.

In the preferred form, the blank is formed of paperboard, and the segments are folded along two longitudinal fold lines and three transverse fold lines of the blank. More specifically, in the preferred embodiment, the partition includes seventeen flaps or segments forming three parallel adjacently disposed four-cell rows to define the twelve-cell partition of rectangular configuration having side cells, end cells and two center cells thereby providing contact separation for the articles. Each of the two center cells of the partition have opposing walls of identical geometric configuration, and the two opposing pair of center side cells have parallel walls of identical geometric configuration.

With this construction, as easily fabricated partition of simple construction is provided that may be machine erected and placed in a container.

Other objects and advantages of the invention will be apparent from the following description taken in conjunction with the drawings wherein:

BRIEF DESCRIPTION OF THE DRAWINGS

In the drawings, like numbers and letters are used to identify like and similar parts throughout the several views.

Figure 1:
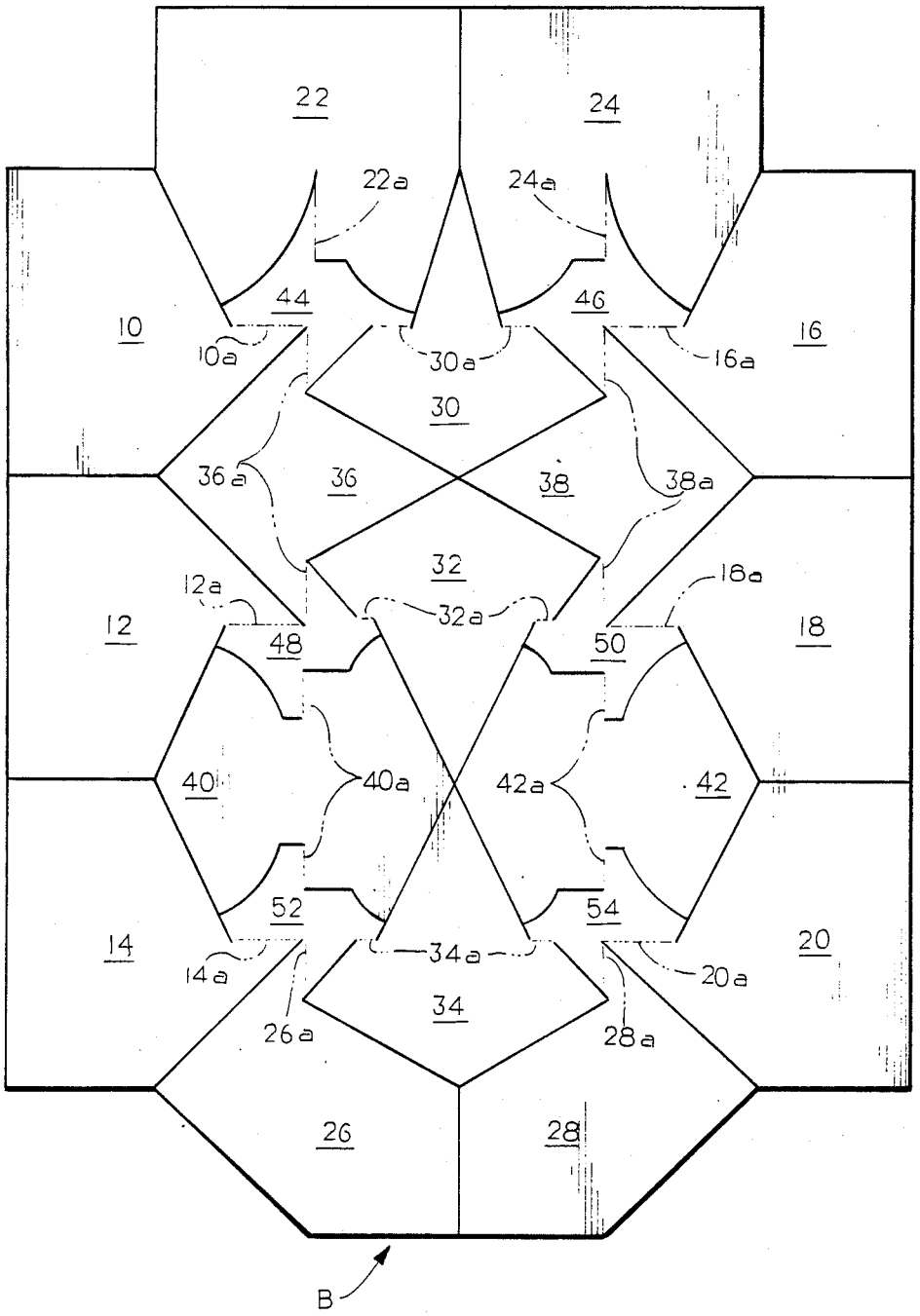
FIG. 1 is a top plan view of a preconfigured container partition blank having cut and fold lines configured in accordance with the invention; with fold lines being shown as dashed lines and cut lines being shown as solid lines.
Figure 2:
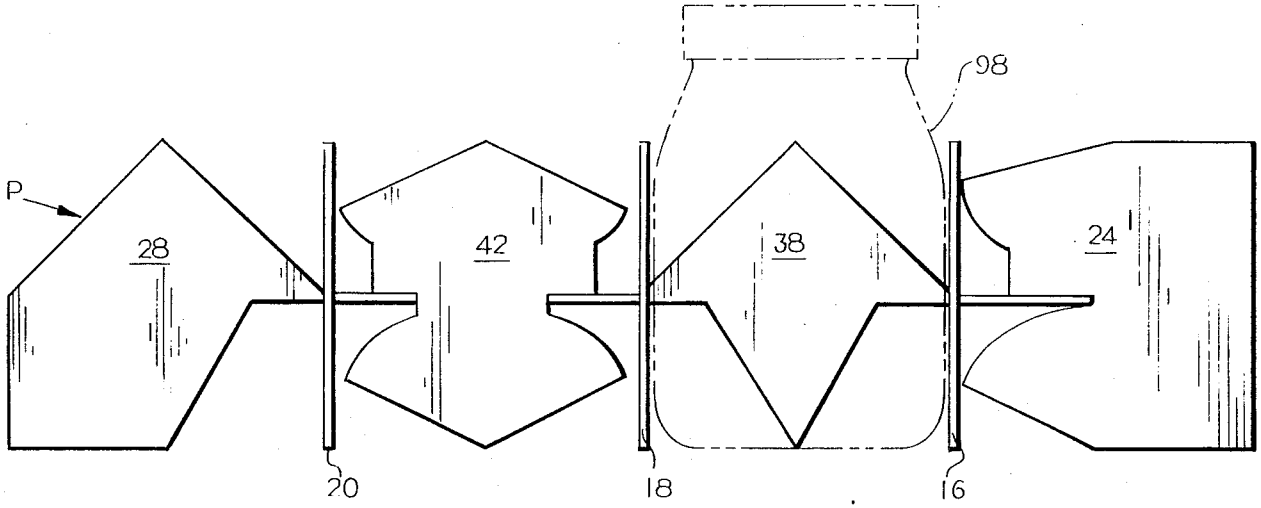
FIG. 2 is a right side elevational view of an erected container partition formed from the blank of FIG. 1.
Figure 3:
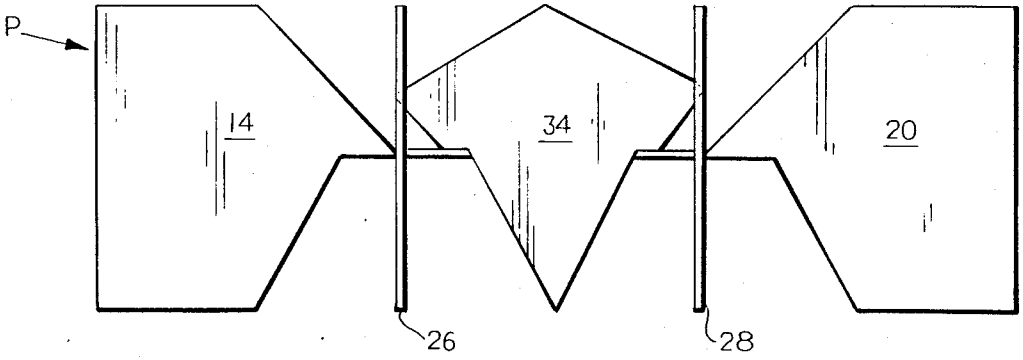
FIG. 3 is a left end view of the erected partition of FIG. 2.

Referring to the drawings, the erected partition P (FIGS. 2, 3 and 4) of the invention is formed from a generally rectangular, planar, blank B (FIG. 1) of foldable sheet material, preferably paperboard which is cut and folded as shown in FIG. 1, wherein the cut lines are shown as solid lines, and the fold lines are shown in dashed lines. When the blank B is cut and folded as in FIG. 1, there is provided a twelve cell partition formed of left side segments 10, 12, 14, (also referred to herein as flaps, or walls or separators) right side segments 16, 18, 20, end segments 22, 24, (other) end segments 26, 28, longitudinal center segments 30, 32, 34, transverse center segments 36, 38, and (other) transverse center segments 40, 42, all of such segments being folded to a vertical position along their respective fold lines, as shown, (areas 44, 46, 48, 50, 52, 54 remaining horizontal), to provide the erected partition P of FIGS. 2, 3 and 4. The fold line(s) of each segment is identified by the same number as the segment, but followed by the letter "a". For example, the fold line of segment 10 is 10*a*.

The combined fold lines 22*a*, 36*a*, 40*a*, and 26*a* effect one generally longitudinal fold line; and the combined fold lines 24*a*, 38*a*, 42*a* and 28*a* effect another generally longitudinal fold line. Likewise, there are three generally transverse fold lines; the first is formed of fold lines 10*a*, 30*a* and 16*a*; the second is formed of fold lines 12*a*, 32*a* and 18*a*; and the third is formed of fold lines 14*a*, 34*a* and 20*a*. Thus, the segments are folded along two generally longitudinal fold lines and three generally transverse fold lines. All of the fold lines are disposed intermediate the top and bottom ends of each of the flaps or segments.

It is to be noted that the following groups of segments are of identical geometric configuration: the end segments 22, 24; end segments 26, 28; side segments 10, 12, 14, 16, 18, 20; center segments 30, 32, 34; transverse center segments 36, 38; and transverse center segments 40, 42. Thus, the two center cells 80, 82 (FIG. 4) have opposing parallel walls of identical geometric configuration. Also, the pair of center side cells 84, 86, the pair of center side cells 88, 90, the end cell 92, and the end cell 94, each have opposing parallel walls of identical geometric configuration.

Figure 4:
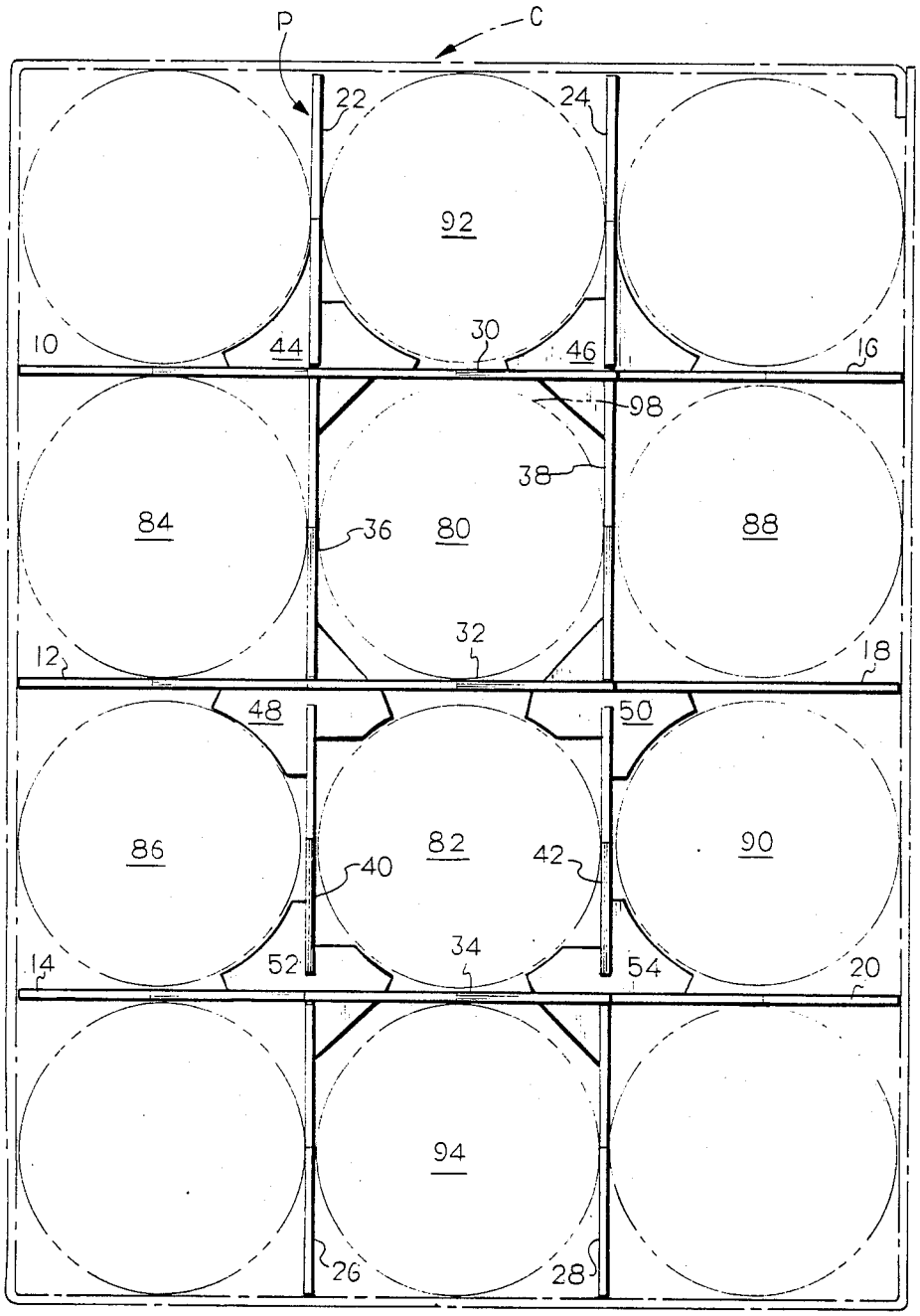
FIG. 4 is a top plan view of the erected partition of FIGS. 2 and 3 and showing the partition placed in a rectangular container, with circular glass jars (in dot-dash lines) placed in the partition cells.

Thus, there is provided a machine erectable compartmented multi-cell one-piece container partition P formed from a unitary blank of foldable paperboard to hold segregated articles (such as the jar 98) in a box or container C. In the preferred embodiment, the partition P includes a rectangular planar horizontally disposed blank B of foldable sheet material, such as paperboard, cut and folded to provide seventeen vertically disposed flaps or segments 10, 12, etc., forming separator walls of single thickness defining a plurality of separator cells 80, 82, etc., to separate the segregated articles (98) at their contact points, with the erected blank B having a length and width the same as planar blank B, not to exceed the inside length and width of container C. Each of the vertically disposed segments 10, 12, etc., are folded from the blank B along a hinge line(s) disposed intermediate the top and bottom ends of each segment, whereby the segments extend above and below the plane of the blank to form walls of the separator cells. Each of the segments may extend below the plane of the blank B an equal distance and/or above the plane of the blank an equal distance. The partition includes seventeen segments forming three parallel adjacently disposed four-cell rows (as shown in FIG. 4) to define the twelve-cell partition of rectangular configuration having side cells, end cells and two center cells thereby providing contact separation for the articles at seventeen possible contact points.

Accordingly, the invention provides a most inexpensive container partition that may be rapidly produced and machine assembled into the box, such partition effecting positive container separation for the segregated articles.

The terms and expressions which have been employed are used as terms of description, and not of limitation, and there is no intention, in the use of such terms and expressions, of excluding any equivalents of the features shown and described of portions thereof, but it is recognized that various modifications are possible within the scope of the invention claimed.

What is claimed is:

1. A compartmented multi-cell one-piece container partition to hold segregated articles having contact points in a box comprising, a rectangular planar horizontally disposed blank of foldable sheet material cut and folded, the blank being so constructed and arranged that there is means to provide vertically disposed segments forming separator walls defining a plurality of separator cells to separate the segregated articles at their contact points with the erected partition having a length and width equal to the planar blank and not exceeding the inside length and width of the box, each of said vertically disposed segments having a top and a bottom end and each segment being folded from the blank along a hinge line disposed intermediate the top and bottom ends of each segment, the vertically disposed segments being so constructed and arranged that adjacent segments cooperate to form a cell for one of the articles, whereby the segments extend above and below the plane of the blank to form walls of the separator cells, there being at least two sets of said hinge lines aligned longitudinally along the blank.

2. The structure of claim 1 wherein each of said segments extends below the plane of the blank an equal distance.

3. The structure of claim 1 wherein each of said segments extends above the plane of the blank an equal distance.

4. The structure of claim 1 wherein each segment is formed of a single thickness of the blank.

5. The structure of claim 1 wherein said blank is formed of paperboard.

6. The structure of claim 1 wherein said segments are folded along two longitudinal fold lines and three transverse fold lines of the blank.

7. The structure of claim 6 wherein the partition has twelve cells.

8. The structure of claim 7 wherein the partition includes seventeen segments forming three parallel adjacently disposed four-cell rows to define the twelve-cell partition of rectangular configuration having side cells, end cells and two center cells thereby providing contact separation for the articles.

9. The structure of claim 8 wherein each of the two center cells of the partition have opposing parallel walls of identical geometric configuration.

10. The structure of claim 8 wherein the two opposing pairs of center side cells have opposed parallel walls of identical geometric configuration.

11. The structure of claim 8 wherein each of the center end cells have opposed parallel walls of identical geometric configuration.

12. The structure of claim 8 wherein all cells except the four corner cells have opposed parallel walls of identical geometric configuration.

13. The structure of claim 1 wherein the length and width is less than the box.

14. The structure of claim 1 wherein the length and width is equal to the box.

15. The structure of claim 1 wherein some of the vertically disposed segments contact either the top of the box.

16. The structure of claim 1 in which some of the vertically disposed segments contact the bottom of the box.

* * * * *